United States Patent [19]

Leguillochet et al.

[11] Patent Number: 4,920,879

[45] Date of Patent: May 1, 1990

[54] PRINTING APPARATUS HAVING AN INTEGRAL SPEED PICKUP WHEEL

[75] Inventors: Pierre Leguillochet, Brecey; Jean Langlet, Caudry, both of France

[73] Assignee: Sermatec, France

[21] Appl. No.: 303,571

[22] Filed: Jan. 27, 1989

[30] Foreign Application Priority Data

Jan. 29, 1988 [FR] France ..... 88 01044

[51] Int. Cl.[5] ..... B41F 5/04

[52] U.S. Cl. ..... 101/219; 101/228

[58] Field of Search ..... 101/228, 227, 219, 37, 101/36, 35

[56] References Cited

U.S. PATENT DOCUMENTS

| | | | |
|---|---|---|---|
| 2,719,482 | 3/1953 | Selley | 101/227 |
| 2,739,528 | 3/1956 | Lowe | 101/37 |
| 2,910,937 | 3/1956 | Hirschey | 101/228 |
| 3,487,776 | 1/1970 | Marozzi | 101/219 |
| 3,603,250 | 11/1968 | Knudsen | 101/36 |
| 4,527,472 | 7/1985 | Davison | 101/219 |

*Primary Examiner*—Clifford D. Crowder

*Attorney, Agent, or Firm*—Steele, Gould & Fried

[57] ABSTRACT

A wheel (15) is freely mounted on the shaft (2) of a printing head and is in contact at its periphery with a film which is to be printed. A tachymeter (10) is provided which detects the speed of rotation of the wheel (15) and transmits a corresponding signal to apparatus (26) for controlling the speed of rotation of the motor (8).

6 Claims, 3 Drawing Sheets

PRINTING APPARATUS HAVING AN INTEGRAL SPEED PICKUP WHEEL

This invention relates to printing apparatus used especially for printing inscriptions on a film in continuous packaging machines.

A printing apparatus is already known which comprises a printing head integral in rotation with a first shaft and defining, with a counter-roller a gap for a film, an inking roller integral in rotation with a second shaft parallel to the first, means for rotationally driving the second shaft when the first shaft rotates, an electric drive motor for the first shaft and a speed pick-up wheel freely mounted on a third shaft and coming into contact at its periphery with the film. The linear velocity of the film and that of the characters carried by the printing head must be the same. For this reason, the speed pickup wheel is provided, separate from the apparatus itself, and it should be positioned on the film along an axial extension of the counter-roller, adjacent to the gap where the printing occurs, in order to accurately detect the speed of the film. The speed of this wheel is detected by a tachometer which is itself separate and arranged outside the housing of the apparatus. The tachometer transmits a speed signal to a means for controlling the speed of rotation of the motor.

Therefore, in order to set up the apparatus, it is necessary to position, mount and connect up the tachometer and the speed pickup wheel when the apparatus is to be used, which is a relatively complicated procedure and a potential source of errors, and may result in the detection of a false value for the speed. It is difficult to simultaneously achieve good positioning of the apparatus ensuring good marking of the film, and good positioning of the speed pickup wheel which ensures satisfactory synchronization of the rotation of the printing head and the speed of travel of the film. Sometimes, in the case of a narrow film, the width of the apparatus is greater than gap is equal that of the film. Then the speed data must be picked up by means of the speed pickup wheel upstream or downstream of the gap. The speed of the film at such a position may be different from the speed of the film in the gap. Finally, the storage and transportation of the apparatus and its accessories are awkward. It is possible for some accessories to be lost.

The invention overcomes these disadvantages with an apparatus which is easier to mount and connect up, takes up less room and is hence able to be integrated more easily in machinery, requires less adjustment and makes it possible to detect the speed of the strip of film in the gap, even if the width of the strip is not greater than that of the apparatus, and rules out any risk of losing the constituent parts.

The apparatus according to the invention is characterized in that the speed pickup wheel is integral with the apparatus, being mounted freely on the third shaft which is incorporated in the apparatus and which extends in the plane defined by the first shaft and second shaft.

Therefore, it is sufficient to position the apparatus correctly in order to adjust the printing and the speed detection in a single operation.

It might seem awkward that the output shaft of the motor and the first shaft to be driven by the motor are not one and the same, which means that a coupling has to be provided between them, but by doing this, particularly when the output shaft of the motor is outside the plane defined the first shaft and shaft the second and when the output shaft of the motor is at a spacing from the first shaft which is greater than the sum of the radius of the printing head and the radius of the motor, it is possible to obtain an apparatus of restricted height and depth, since this construction takes account of the fact that two of the bulkiest elements are the motor and the first shaft with the printing head. It is therefore expedient to accommodate them side by side in order to obtain an apparatus which takes up little space. The space freed behind the printing head can then be put to good use accommodating the speed pickup wheel and/or the tachometer, the wheel being situated precisely on the gap.

Preferably, the third shaft coincides with the first.

Preferably, the tachometer is mounted on a fourth shaft parallel to the first and interposed between the latter and the output shaft of the motor, and a coupling is provided between the third shaft and the fourth shaft. Thus, the tachymeter can be accommodated without increasing the thickness of the apparatus. Again, for this same reason of bulk, the pivot axis of the apparatus which is parallel to the first shaft and arranged laterally relative to the gap, is on the same side of the first shaft as the output shaft.

In order to protect the wheel, the majority of the speed pickup wheel may be housed inside the housing. Similarly, the tachometer is housed entirely within the housing.

In the accompanying drawings, which are given solely by way of example:

Figure 1:
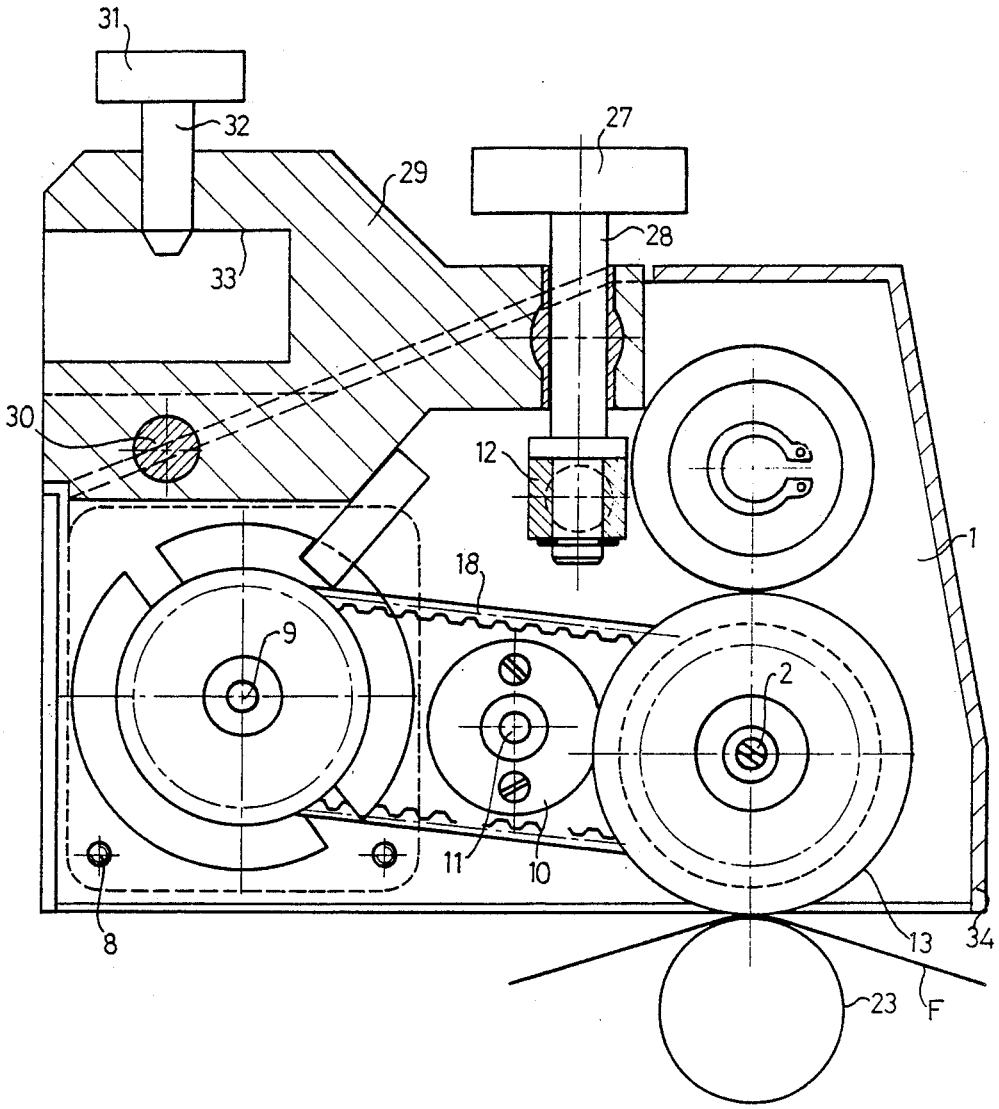
FIG. 1 is a rear elevation of the apparatus according to the invention, with the lever shown in section.
Figure 2:
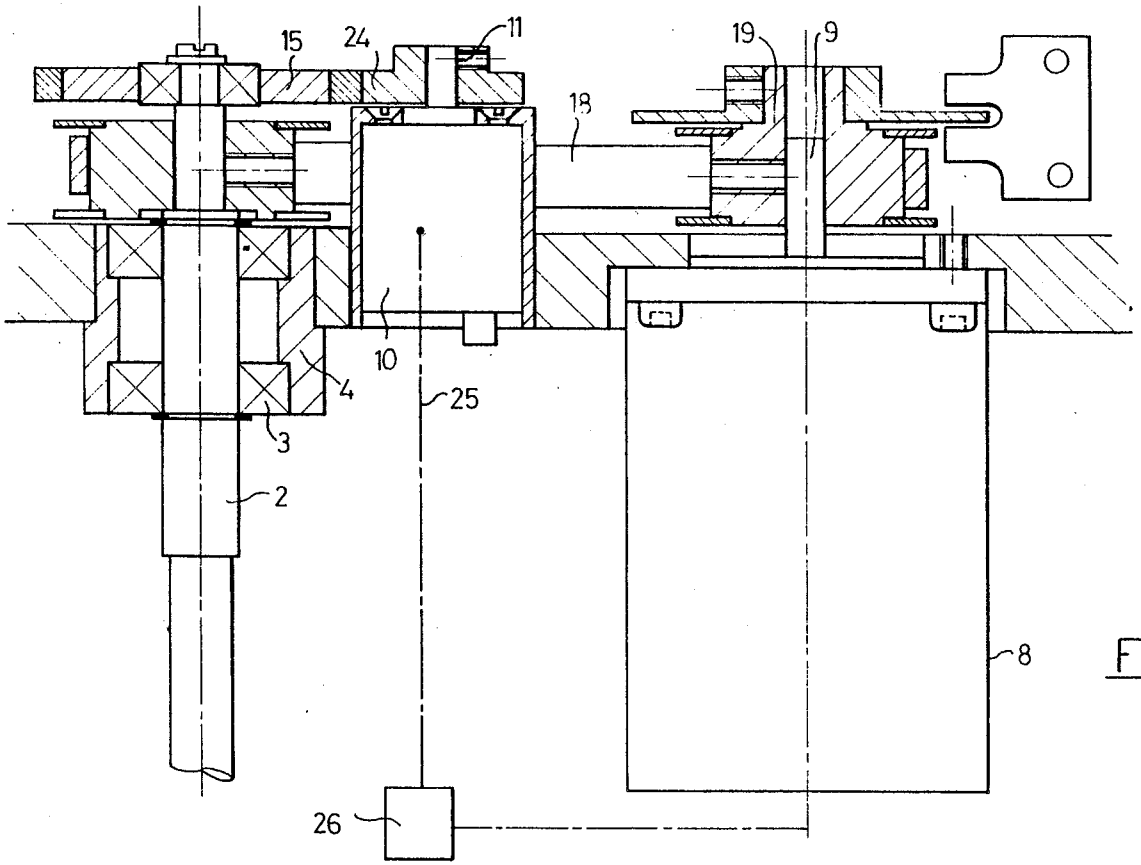
FIG. 2 is a section in the plane defined by the first shaft and the output shaft of the motor.
Figure 3:
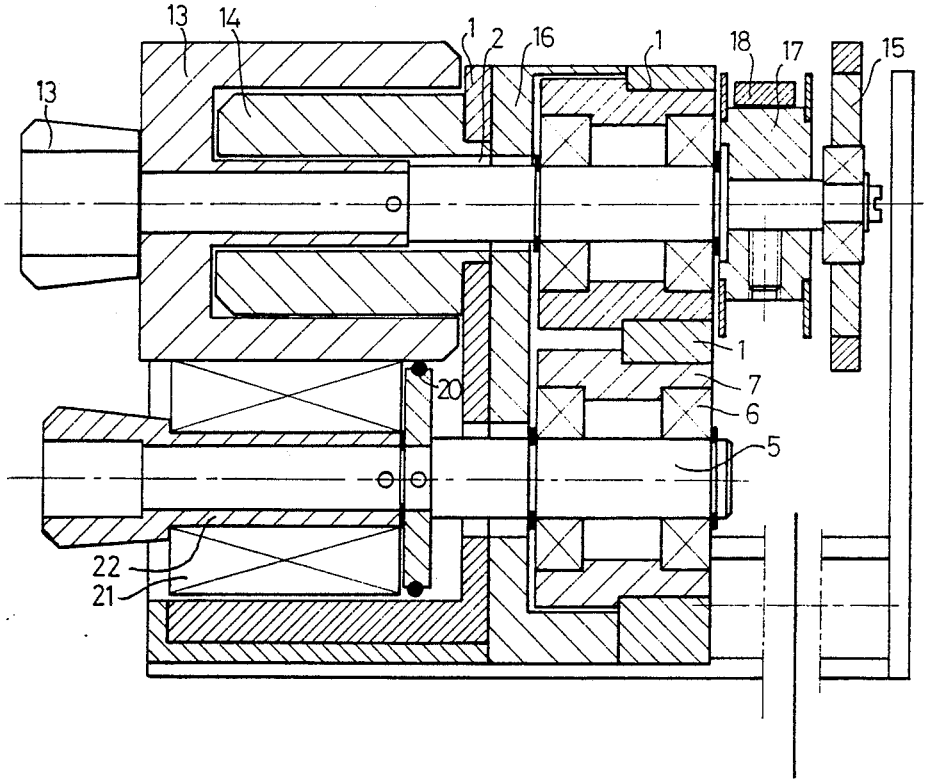
FIG. 3 is a section in the plane defined by the first shaft and second shaft.

The printing apparatus shown in the drawings comprises a frame 1 in which five openings are drilled. In the first, a first shaft 2 is mounted on ball bearings 3 and bearings 4. In the second opening is mounted a second shaft 5 on ball bearings 6 and bearings 7. In the third opening is mounted an electric motor 8 having an output shaft 9. In a fourth opening is mounted an incremental coder acting as a tachometric generator 10 on a fourth shaft 11. Through the fifth opening passes an adjustment rod 12 which forms part of the pivoting device which will be described hereinafter.

A printing head consisting of a type carrier 13 with heating elements 14 incorporated therein is mounted so as to be integral in rotation with the shaft 2. On the same first shaft 2, a speed pickup wheel 15 is freely mounted. The heating elements 14 are separated from the other constituent elements behind them by an insulating plate 16. Between the plate 16 and the wheel 15 is mounted, on the first shaft 2, a pulley 17 which receives a belt 18 passing over a pulley 19 mounted on the output shaft 9 of the motor 8.

The printing head 13 frictionally drives, via a toric joint 20, an inking roller 21 which is mounted so as to be rotationally integral with the second shaft 5. The shafts 2, 5, 9 and 11 are parallel.

A plastic film F which is to be printed passes into the gap formed between the printing head 13 and a counter-roller 23.

The speed pickup wheel 15 frictionally drives a stepping-down pinion 24 mounted on the shaft 11. The speed of rotation of the shaft 11 is transmitted to the coder 10 and transmits this speed through a line 25 to control means 26 controlling the speed of rotation of the output shaft 9 of the motor 8. The electronic control means 26 are housed in a cupboard outside the apparatus.

A knob 27 acts on the rod 12 via a threaded rod 28, so as to regulate the contact force of the printing head 13 on the film F. A thread on a lever 29 meshes with the threaded rod 28 and is pivotally mounted on the plate 1 by means of a pivot spindle 30 parallel to the shaft 9. A knob 31 with a threaded rod 32 projects into a recess 33 for receiving a support bar for the apparatus, this bar, which is not shown, being substantially parallel to the spindle 9. By screwing the threaded rod 28 to a greater or lesser extent into the corresponding thread, it is possible to pivot the lever 29 about the pivot spindle 30 so as to cause the printing head 13 to pivot more or less towards the counter-roller 23.

In order to print the film F the motor 8 is made to rotate. The output shaft 9 of the motor drives the first shaft 2 via the belt 18. The printing head 13 turns at approximately the same speed as the film F. At the same time, the speed pickup wheel 15 rubbing against the film F is peripherally driven at this film speed and transmits the speed information to the tachometer 10 via the pinion 24. The tachometer 10 transmits this speed information to the means 26 which consequently adjusts the speed of the motor 8. At the same time, the printing head 13 causes the inking roller 21 to rotate via the joint 20.

The greater part of the wheel 13 is housed inside a housing 34 in which the tachometer 10 is accommodated fully and which also surrounds the remainder of the apparatus, with the exception of the control means 26, the lever 29 and the counter-roller 23.

The output shaft 9 of the motor 8 is at a spacing from the first shaft 2 greater than the sum of the radius of the printing head 13 and the radius of the motor 8.

I claim:

1. A printing apparatus comprising a first shaft, a printing head integral in rotation with the first shaft, a counter-roller defining with the printing head a gap for a film, a second shaft parallel to the first shaft, an inking roller fixed for rotation with the second shaft, means for rotating the second shaft when the first shaft turns, an electric motor having an output shaft and means for driving the first shaft, a third shaft parallel to the first shaft and located in a plane defined by the first shaft and the second shaft, a speed pickup wheel mounted freely on the third shaft and in contact at its periphery with the film, a fourth shaft parallel to the first shaft, a tachometer mounted on the fourth shaft, and a coupling between the speed pickup wheel and the tachometer, whereby the tachometer detects the speed of rotation of the speed pickup wheel.

2. A printing apparatus comprising a first shaft, a printing head integral in rotation with the first shaft, a counter-roller defining with the printing head a gap for a film, a speed pickup wheel mounted freely on the first shaft and in contact at its periphery with the film, a second shaft parallel to the first shaft, an inking roller fixed for rotation with the second shaft, means for rotating the second shaft when the first shaft turns, an electric motor having an output shaft and means for driving the first shaft, a further shaft parallel to the first shaft, a tachometer mounted on the further shaft, and a coupling between the speed pickup wheel and the tachometer, whereby the tachometer detects the speed of rotation of the speed pickup wheel.

3. The apparatus of claim 2, further comprising a control means, outside the apparatus, for controlling the speed of rotation of the output shaft of the motor, and wherein the tachometer sends a signal corresponding to the rotational speed of the speed pickup wheel to said control means.

4. The apparatus of claim 3, wherein the output shaft of the motor is outside the plane defined by the first shaft and the second shaft.

5. The apparatus of claim 4, wherein the output shaft of the motor is at a spacing from the first shaft greater than the sum of the radius of the printing head and the radius of the motor.

6. The apparatus of claim 3, wherein the further shaft is mounted parallel to the first shaft and interposed between the first shaft and the output shaft of the motor.

* * * * *